US006918476B2

(12) United States Patent
Chou

(10) Patent No.: US 6,918,476 B2
(45) Date of Patent: Jul. 19, 2005

(54) REINFORCED ARRANGEMENT FOR SLIDING TUBE OF WHEELED LUGGAGE

(75) Inventor: Ching Wei Chou, Taipei (TW)

(73) Assignee: Chaw Khong Technology Co., Ltd., Taipei (TW)

( * ) Notice: Subject to any disclaimer, the term of this patent is extended or adjusted under 35 U.S.C. 154(b) by 24 days.

(21) Appl. No.: 10/617,379

(22) Filed: Jul. 11, 2003

(65) Prior Publication Data

US 2004/0016614 A1 Jan. 29, 2004

(30) Foreign Application Priority Data

Jul. 24, 2002 (CN) ..... 02125319 A

(51) Int. Cl.[7] ..... A45C 13/26
(52) U.S. Cl. ..... 190/115; 16/113.1
(58) Field of Search ..... 16/113.1; 190/115

(56) References Cited

U.S. PATENT DOCUMENTS 5,488,756 A * 2/1996 Hsieh ..... 16/113.1
5,497,865 A * 3/1996 Yun-Pi ..... 190/115
5,692,266 A * 12/1997 Tsai ..... 16/113.1
5,901,822 A * 5/1999 Tu ..... 190/115
6,332,241 B1 * 12/2001 Kuo ..... 16/113.1
6,338,586 B1 * 1/2002 Kuo ..... 403/109.7
6,338,587 B1 * 1/2002 Kuo ..... 403/109.7
6,497,311 B2 * 12/2002 Tiramani et al. ..... 190/115
6,609,271 B2 * 8/2003 Kuo ..... 16/113.1

* cited by examiner

*Primary Examiner*—Tri M. Mai
(74) *Attorney, Agent, or Firm*—Troxell Law Office, PLLC

(57) ABSTRACT

A reinforced arrangement for a handle assembly of wheeled luggage is disclosed. The handle assembly comprises two units each having a support tube and a sliding tube. The reinforced arrangement comprises an abutment mechanism under the sliding tube, a fixed pin for fastening the abutment mechanism and the sliding tube together, and a reinforced pin in the abutment mechanism urged against a wall of the sliding tube. Responsive to fully extending the sliding tubes for forming an H-shaped reinforced structure on portions of the wall of each sliding tube being in contact with the reinforced pin at about an opening of a bezel. That is, reinforcement is formed at points of external force exerted on the sliding tube while towing the luggage along a supporting surface for preventing the sliding tube from being bent or deformed.

4 Claims, 4 Drawing Sheets

REINFORCED ARRANGEMENT FOR SLIDING TUBE OF WHEELED LUGGAGE

BACKGROUND OF THE INVENTION

1. Field of the Invention

The present invention relates to sliding tubes of a wheeled luggage and more particularly to the sliding tube having a reinforced arrangement for preventing a deformation thereof from occurring so as to prolong a useful life of the luggage.

2. Description of Related Art

Conventionally, tubes (e.g., sliding tubes and support tubes) of a wheeled luggage are made of lightweight aluminum for reducing weight of the luggage. Also, a wall of the tube is made thinner for saving manufacturing cost due to a high unit price of the aluminum material. However, the thinner tubes suffered from several disadvantages. For example, the total weight of luggage is concentrated on the walls of the sliding tubes, it means that the total external force is exerted on a portion of the wall of the sliding tubes, as the sliding tubes are extended for enabling a user to tow the luggage along a supporting surface. As an end, the sliding tubes will therefore tend to bend or deform even after a short period of time of use. This can shorten a useful life of the luggage. Moreover, more external force is exerted on the luggage while towing along an uneven supporting surface. As understood that the sliding tubes are not able to retract into the support tubes if the sliding tubes are bent or deformed. Hence, a need for improvement exists.

SUMMARY OF THE INVENTION

It is an object of the present invention to provide a reinforced arrangement for a sliding tube of wheeled luggage in which an H-shaped reinforced structure is formed on portions of the sliding tube's wall being in contact with a reinforced pin at about a bottom opening of bezel. As such, reinforcement is formed at points of force exerted on the sliding tube while towing the luggage along a supporting surface for preventing the sliding tube from being bent or deformed. By utilizing this, a useful life of wheeled luggage can be prolonged.

To achieve the above and other objects, the present invention provides a reinforced arrangement for a handle assembly of wheeled luggage, the handle assembly including two units each having a support tube and a sliding tube, the reinforced arrangement comprising an abutment mechanism under the sliding tube; a lock pin for fastening the abutment mechanism and the sliding tube together; and a reinforced pin in the abutment mechanism urged against a wall of the sliding tube, wherein responsive to fully extending the sliding tubes for forming an H-shaped reinforced structure on portions of the wall of each of the sliding tubes being in contact with the reinforced pin at about an opening of a bezel.

The above and other objects, features and advantages of the present invention will become apparent from the following detailed description taken with the accompanying drawings.

DETAILED DESCRIPTION OF THE PREFERRED EMBODIMENTS

Figure 1:
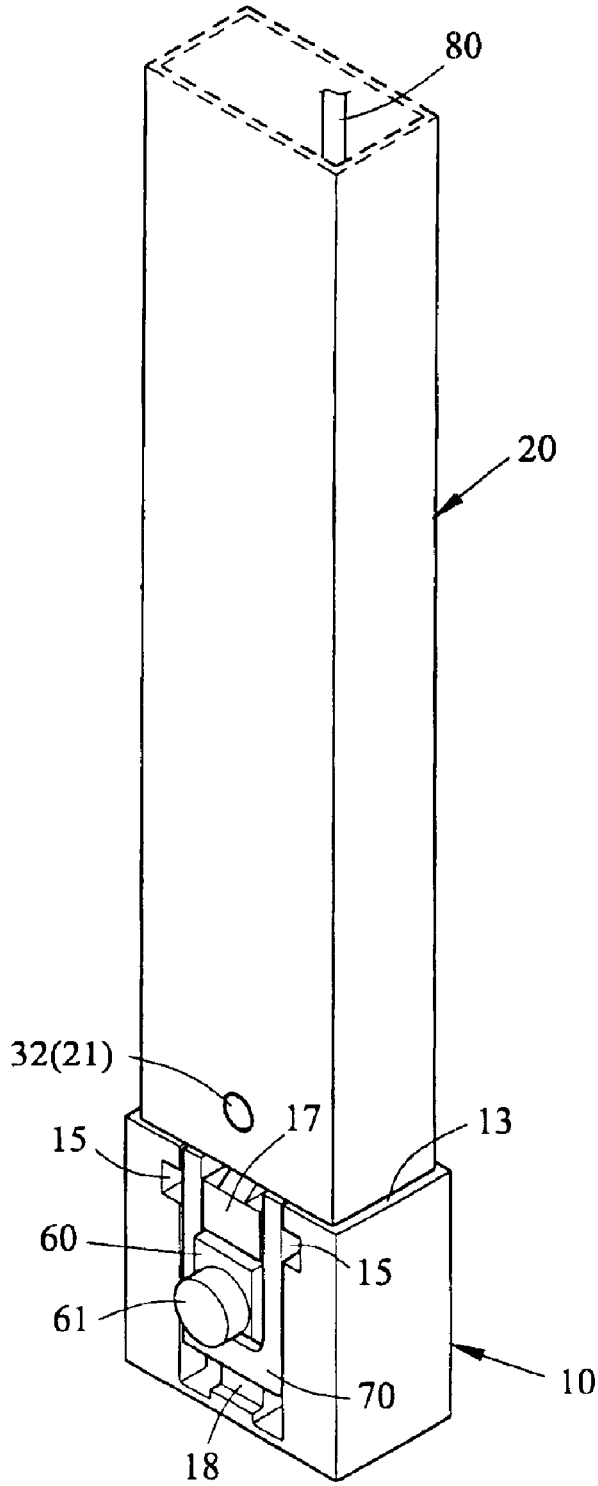
FIG. 1 is a perspective view of a preferred embodiment of reinforced arrangement for sliding tube of wheeled luggage according to the invention.
Figure 2:
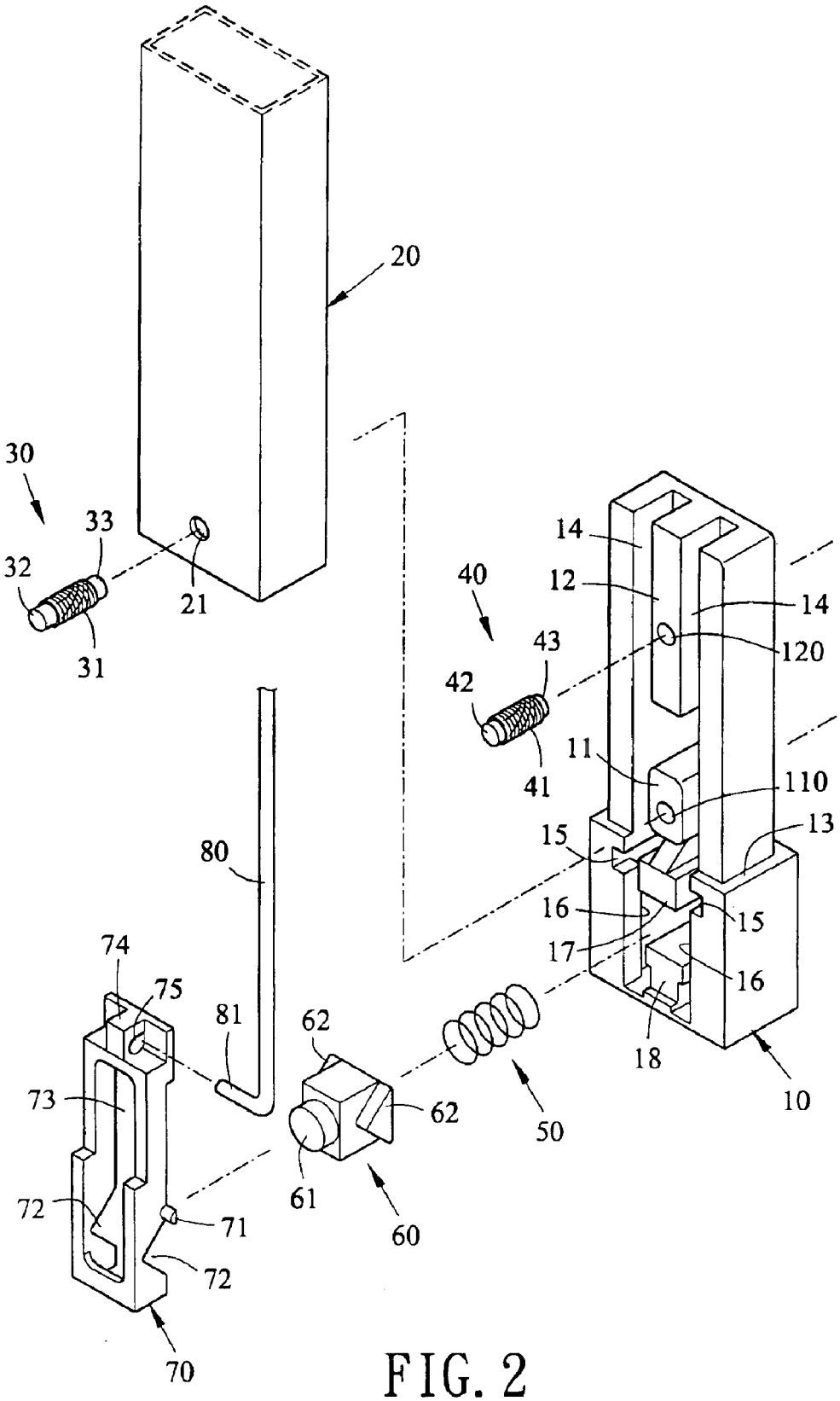
FIG. 2 is an exploded perspective view of FIG. 1.

Referring to FIGS. 1 and 2, there is shown a reinforced arrangement mounted in a handle assembly of wheeled luggage constructed in accordance with the invention. The reinforced arrangement comprises an abutment mechanism 10, a fixed pin 30, and a reinforced pin 40 all mounted within a lower portion of the sliding tube 20. Each component will be described in detail below.

The abutment mechanism 10 is an upright staged member and comprises a lower first pin mounting member 11 having a first through hole 110 and an upper second pin mounting member 12 having a second through hole 120. The reinforced pin 40 comprises a knurled shank 41 and two fastening ends 42, 43 each having a diameter slightly smaller than that of the knurled shank 41. The knurled shank 41 is inserted into the second through hole 120. After the sliding tube 20 has been put on the abutment mechanism 10, the fastening ends 42, 43 contact an inner wall of the sliding tube 20. The sliding tube 20 comprises two opposite apertures 21 adjacent a bottom thereof. The apertures 21 are aligned with the first through hole 110 when the sliding tube 20 is seated on an intermediate shoulder 13 of the abutment mechanism 10. The fixed pin 30 has the same construction as the reinforced pin 40 and comprises a knurled shank 31 and two fastening ends 32, 33 each having a diameter slightly smaller than that of the knurled shank 31. The fixed pin 30 is inserted into the apertures 21 and the first through hole 110 for fastening the sliding tube 20 and the abutment mechanism 10 together in which the knurled shank 31 and the fastening ends 32, 33 are received in the first through hole 110 and the apertures 21 respectively. As a result, reinforcement is formed at points of force exerted on the sliding tube 20 while towing luggage along a supporting surface by urging the reinforced pin 40 against the inner wall of the sliding tube 20 as detailed later.

Figure 3:
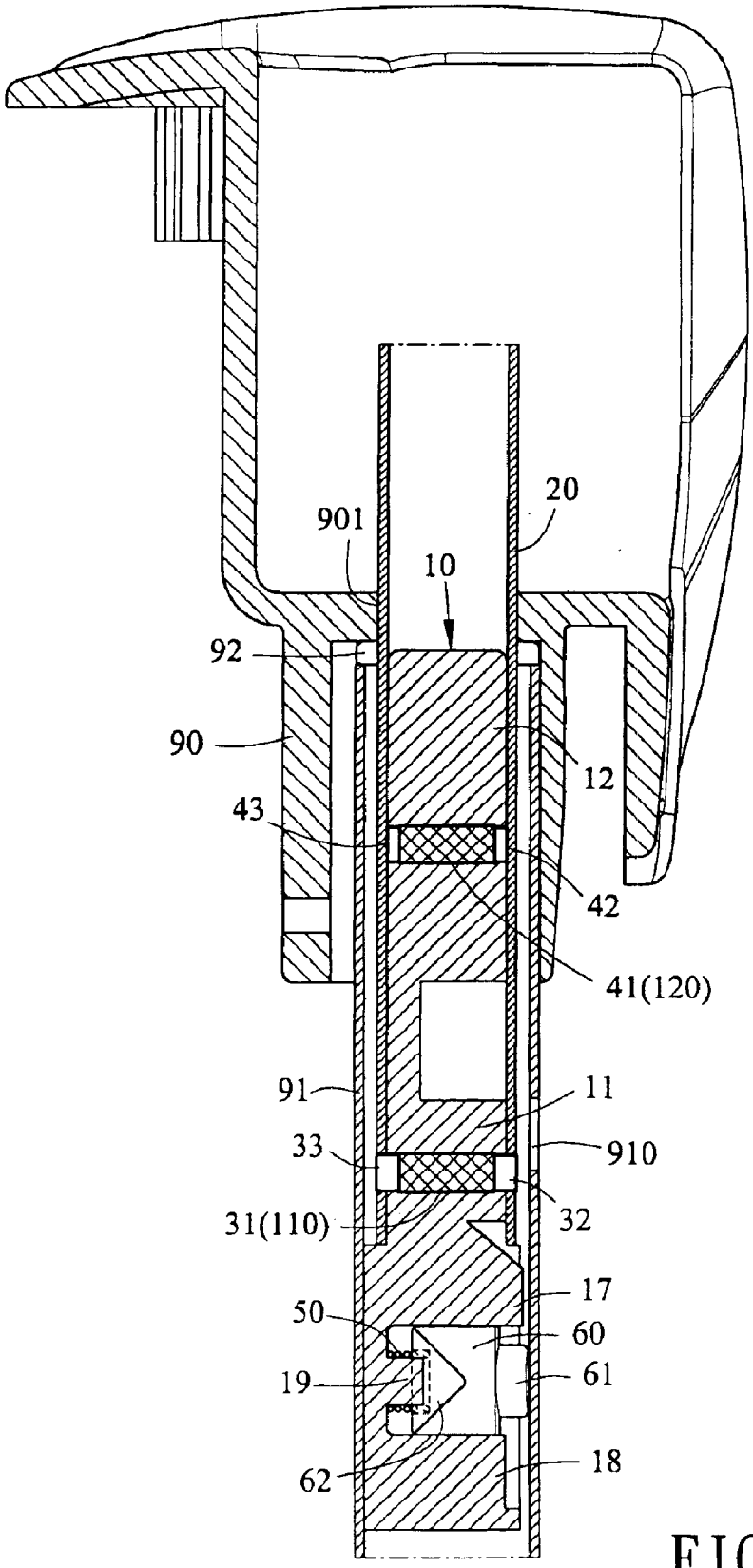
FIG. 3 is a cross-sectional view of the reinforced arrangement mounted in a luggage case where the sliding tube is retracted in a support tube as a handle assembly is locked.
Figure 4:
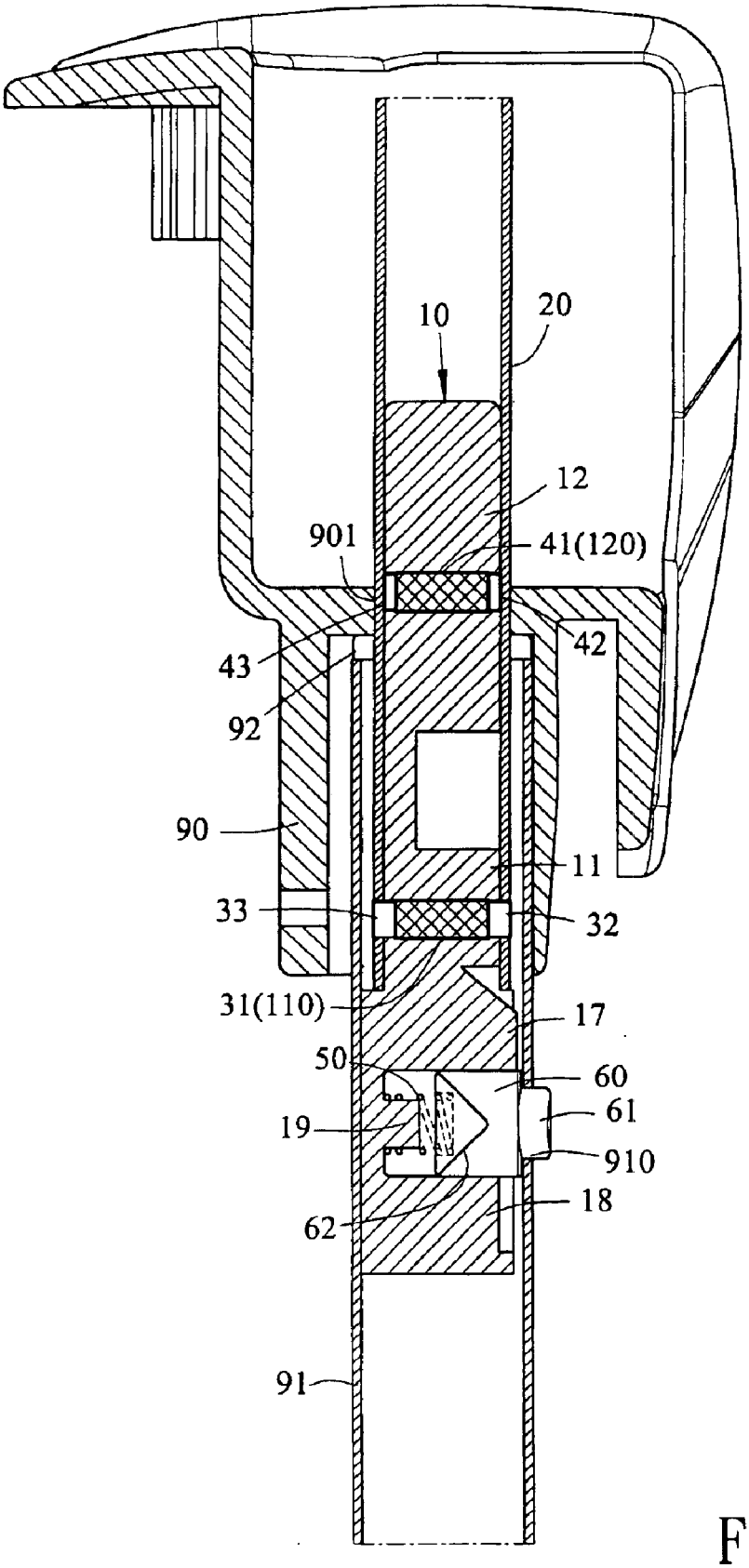
FIG. 4 is a view similar to FIG. 3 where the sliding tube is extended as the handle assembly is unlocked.

Referring to FIGS. 3 and 4, a support tube 91 having a rectangular section is extended downward from a bezel 90 of luggage to a bottom of the luggage. A sleeve 92 is put on the support tube 91. Both the abutment mechanism 10 and the sliding tube 20 are able to slide along the support tube 91. Further, the sliding tube 20 is able to extend out of the bezel 90 by passing an opening 901 of the bezel 90. Once the sliding tube 20 extends from the bezel 90, a H-shaped reinforced structure is formed as the reinforced pin 40 in the second through hole 120 is urged against the inner wall of the sliding tube 20 (see FIG. 3). As shown, the abutment mechanism 10 will go up as the sliding tube 20 has fully extended because as stated above, the fixed pin 30 is inserted into the apertures 21 and the first through hole 110 for fastening the sliding tube 20 and the abutment mechanism 10 together. Further, the H-shaped reinforced structure is provided at about the opening 901 (the bottom of the bezel 90) (see FIG. 4). Weight of luggage is concentrated on the sliding tubes 20, particularly at the inner walls of the sliding tubes 20 adjacent the openings 901 of the bezel 90 while towing the slanted luggage along a supporting surface. Fortunately, the H-shaped reinforced structure can bear much of the luggage's weight. As such, a possible deformation or bent at the inner wall of the sliding tube 20 adjacent the opening 901 of the bezel 90 is substantially avoided. As an end, a useful life of the wheeled luggage can be prolonged.

Referring to FIGS. 1 and 2 again, a locking device is formed in the abutment mechanism 10. In detail, the locking device comprises a helical spring 50, a locking block 60, a driven mechanism 70, and a connecting cable 80. Each component will be described in detail below. The abutment mechanism 10 further comprises two longitudinal grooves 14 along two opposite sides of the first and second pin mounting members 11, 12, two transverse troughs 15 below the grooves 14, two stop members 16 below the troughs 15, an upper abutment 17, a lower abutment 18 both below the first pin mounting member 11, and a spring shaft 19 between and spaced apart from the upper and lower abutments 17 and 18. The locking block 60 comprises a side protuberance 61 and two V-shaped projections 62 at two opposite sides. The locking block 60 is disposed between the upper and lower abutments 17 and 18 for urging against the helical spring 50 put on the spring shaft 19. The driven mechanism 70 is a hollow frame and comprises an elongated rectangular channel 73, two guide bars 71 at both sides, two V-shaped recesses 72 at both sides, a top ridge 74, and a hole 75 in the ridge 74. The connecting cable 80 has a bottom end formed as a hook 81 inserted in the hole 75 so that the driven mechanism 70 and the connecting cable 80 can operate together. Once the driven mechanism 70 is mounted in the abutment mechanism 10, the driven mechanism 70 is slidable along the grooves 14, the guide bars 71 is inserted into the troughs 15 and stopped by the stop members 16, the upper and lower abutments 17 and 18 and the locking block 60 are received in the channel 73, the V-shaped projections 62 and the V-shaped recesses 72 are matingly engaged, and the connecting cable 80 passes one of the grooves 14. This forms the locking device of the invention.

Referring to FIGS. 2, 3 and 4 again, a lock aperture 910 is formed at a wall of the support tube 91. In a case that the sliding tube 20 is retracted or not fully extended, the helical spring 50 is compressed by the protuberance 61 of the locking block 60 which is in contact with an inner wall of the support tube 91. As shown in FIG. 3, a top of the abutment mechanism 10 is about flush with a top of the support tube 91. In another case that the sliding tube 20 is fully extended the abutment mechanism 10 also rises. The helical spring 50 is expanded suddenly once the protuberance 61 arrives the lock aperture 910. At the same time, the protuberance 61 projects through the lock aperture 910 for locking the sliding tube 20 relative to the support tube 91, i.e., the handle assembly is locked. As shown in FIG. 4, the H-shaped reinforced structure is at about the opening 901. For unlocking the handle assembly, a user can lower the driven mechanism 70 by operating the connecting cable 80. The lowered driven mechanism 70 causes the locking block 60 to move laterally due to the engagement of the V-shaped projections 62 and the V-shaped recesses 72. Next, the laterally moved locking block 60 causes the protuberance 61 to clear from the lock aperture 910. As a result, the sliding tube 20 is unlocked, i.e., the handle assembly is unlocked (see FIG. 3).

In the embodiment shown above, each of the sliding tube 20, the support tube 91, and the abutment mechanism 10 has a rectangular section. In another embodiment, each of the sliding tube 20, the support tube 91, and the abutment mechanism 10 may have an oval section. In a further embodiment, each of the sliding tube 20, the support tube 91, and the abutment mechanism 10 may have a circular section.

While the invention herein disclosed has been described by means of specific embodiments, numerous modifications and variations could be made thereto by those skilled in the art without departing from the scope and spirit of the invention set forth in the claims.

What is claimed is:

1. A handle assembly of wheeled luggage having a bezel on a rear top, the handle assembly comprising:

two units each having a support tube and a sliding tube;

an abutment mechanism provided at a lower portion of the sliding tube;

a fixed pin for fastening the abutment mechanism and the sliding tube together; and a reinforced pin in the abutment mechanism urged against a wall of the sliding tube, wherein responsive to fully extending the sliding tubes, an H-shaped reinforced structure is formed on portions of the wall of each of the sliding tubes being in contact with the reinforced pin at about a bottom opening of the bezel, wherein the abutment mechanism is an upright staged member and comprises a lower first pin mounting member having a first through hole and an upper second pin mounting member having a second through hole;

the reinforced pin comprises a first knurled shank inserted into the second through hole and two first fastening ends;

the sliding tube comprises two opposite apertures adjacent a bottom thereof, the apertures being aligned with the first through hole when the sliding tube is seated on an intermediate shoulder of the abutment mechanism; and the fixed pin comprises a second knurled shank and two second fastening ends so that responsive to inserting the fixed pin into the apertures and the first through hole receiving the second knurled shank and the second fastening ends the first through hole and the apertures respectively.

2. The handle assembly of claim 1, wherein the first knurled shank has a diameter larger than that of each of the first fastening ends.

3. The handle assembly of claim 1, wherein the second knurled shank has a diameter larger than that of each of the second fastening ends.

4. A handle assembly of wheeled luggage having a bezel on a rear top, the handle assembly comprising:

two units each having a support tube and a sliding tube;

an abutment mechanism provided at a lower portion of the sliding tube;

a fixed pin for fastening the abutment mechanism and the sliding tube together; and a reinforced pin in the abutment mechanism urged a against a wall of the sliding tube, wherein responsive to fully extending the sliding tubes, an H-shaped reinforced structure is formed on portions of the wall of each of the sliding tubes being in contact with the reinforced pin at about a bottom opening of the bezel, wherein the abutment mechanism further comprises two longitudinal grooves along two opposite sides of the first and second pin mounting members, two transverse troughs below the grooves, two stop members below the troughs, an upper abutment, a lower abutment both below the first pin mounting member, and a spring shaft between and spaced apart from the upper and the lower abutments, and further comprising a locking device comprising:

a helical spring put on the spring shaft;

a substantially parallelepiped locking block disposed between the upper and the lower abutments for urging against the helical spring, the locking block comprising a side protuberance and two V-shaped projections at two opposite sides;

a hollow, substantially parallelepiped driven mechanism comprising an elongated rectangular channel, two guide bars at both sides, two V-shaped recesses at both sides, a top ridge, and a hole in the ridge; and a connecting cable having an end hook inserted in the hole of the driven mechanism for enabling the driven mechanism and the connecting cable to operate together;

wherein responsive to mounting the driven mechanism in the abutment mechanism for sliding the driven mechanism along the grooves, inserting the guide bars into the troughs until being stopped by the stop members, receiving the upper and the lower abutments and the locking block in the channel, matingly engaging the V-shaped projections with the V-shaped recesses, and causing the connecting cable to pass one of the grooves.

* * * * *